US005473113A

United States Patent [19]

Aldissi

[11] Patent Number: 5,473,113

[45] Date of Patent: Dec. 5, 1995

[54] SHIELDED WIRE AND CABLE

[75] Inventor: Mahmoud Aldissi, Colchester, Vt.

[73] Assignee: Champlain Cable Corporation, Winooski, Vt.

[21] Appl. No.: 949,306

[22] Filed: Sep. 22, 1992

[51] Int. Cl.[6] ..... H01B 7/34

[52] U.S. Cl. ..... 174/36; 174/34; 174/107; 174/109

[58] Field of Search ..... 174/36, 32, 34, 174/107, 109

[56] References Cited

U.S. PATENT DOCUMENTS

| | | | |
|---|---|---|---|
| 4,301,428 | 11/1981 | Mayer | 333/12 |
| 4,408,089 | 10/1983 | Nixon | 174/34 |
| 4,506,235 | 3/1985 | Mayer | 333/12 |
| 4,684,762 | 8/1987 | Gladfelter | 174/36 |
| 4,822,950 | 4/1989 | Schmitt | 174/36 |
| 4,920,233 | 4/1990 | Kincaid | 174/36 |
| 4,960,965 | 10/1990 | Redmon et al. . | |
| 5,103,884 | 4/1992 | Aldissi | 174/36 |
| 5,180,884 | 1/1993 | Aldissi | 174/36 |
| 5,262,591 | 11/1993 | Aldissi | 174/36 |
| 5,262,592 | 11/1993 | Aldissi | 174/36 |

FOREIGN PATENT DOCUMENTS

| | | | |
|---|---|---|---|
| 1019727 | 11/1957 | Germany | 174/36 |
| 1622297 | 12/1977 | Germany | 174/36 |
| 244008 | 3/1987 | Germany | 174/36 |
| 40886 | 4/1978 | Japan | 174/109 |
| 999545 | 7/1965 | United Kingdom | 174/36 |

*Primary Examiner*—Morris H. Nimmo
*Attorney, Agent, or Firm*—Salzman & Levy

[57] ABSTRACT

The present invention features a shielded wire and cable article capable of meeting stringent aerospace specifications and requirements, particularly those pertaining to low weight and high temperature. The article generally consists of an inner conductive core of one or more wires that can be twisted or braided and which can be individually insulated. The conductive core is surrounded by one or more thin layer(s) of insulation about which the shielding of this invention is overlaid. The shielding is made of a woven, braided or served mesh or woven yarn of metal-coated high-performance fibers. The fibers of the mesh or yarn are characterized by high-tensile strength and flexibility and are operative at high temperatures, equal to or exceeding 150° C. When the fibers themselves are braided, the resulting mesh can be braided even more tightly about the interior insulation surface than can conventional meshes.

18 Claims, 1 Drawing Sheet

SHIELDED WIRE AND CABLE

FIELD OF THE INVENTION

The invention relates to shielded wire and cable, and, more particularly, to improved shielded wire and cable having a shield layer that is fabricated from metal-coated, high-performance, liquid crystalline polymer fibers that have been woven, braided or served to form a shielding mesh.

BACKGROUND OF THE INVENTION

Advanced technological uses for wire and cable have imposed many new requirements upon traditional wire and cable specifications and functions. In missile and aerospace environments, for example, the need for light-weight cabling is directly related to aircraft performance, as well as operating cost. Wiring is also often required to meet stringent shielding specifications, since a missile or aircraft must fly through radiation and electrical interference fields without compromising the on-board electronics.

Wire and cables are currently shielded electrically by braiding shields of wire mesh about the primary wire core and insulation. This shielding is meant to prevent RFI and EMI disturbances from influencing the signals in the cable.

As advanced technology requirements impose greater stringency on shielding and weight specifications, the previously functional braided articles become less acceptable. Shielding leakages occur in these conventional cables, owing to the looseness with which the wire mesh is braided, creating holes in the shield web. In addition, the stiffness of the braided metal wire makes it difficult to conform the mesh to the surfaces of the insulation and core and thus leaves small gaps. Such gaps limit the frequency range in which the cable or wire can be operationally effective. While it may be possible to use a finer wire mesh to resolve some of the above-mentioned shielding problems, it is still necessary to contend with the low-weight requirements that these environments impose. The low-weight requirements cannot be practically met by utilizing the conventional wire mesh braiding techniques.

U.S. Pat. No. 5,103,067 issued on Apr. 7, 1992, to Mahmoud Aldissi and having a common assignee, for SHIELDED WIRE AND CABLE taught that the shielding of wire and cable could be greatly enhanced by the use of metal-coated high-strength fibers woven into a shield layer.

The present invention expands upon the teachings of the aforementioned patent, with new shielded wire and cable articles using high-performance liquid crystalline polymers such as poly (p-phenylene-2,6-benzobisthiazole) [hereinafter referred to as PBT], polybenzoxazole (PBO), polybenzimidazole (PBI), polyester-polyarylate and polyester-polyarylate commingled with glass fibers. The new wire and cable articles of this invention further suggest the use of shielding fibers that comprise ceramic materials, such as silicon carbide and carbon-coated silicon carbide. The invention also contemplates fibers consisting of bridged macrocyclic metal complexes and hybrids, such as polyphthalocyanines. The fibers may also include inherently conductive materials such as polythiophenes and polyanilines. All of the fibers are coated with a thin metallic layer of silver, copper or nickel. Thereafter, the metal-coated fibers may be woven, braided or served into a mesh or shield layer to provide shielding in frequency ranges of approximately between 100 KHz and 1 GHz or greater.

The high-tensile strength and the flexibility of the fibers of this invention guarantee that the fibers can be made thin without losing their structural integrity. The thinner the fiber, the more tightly it can be braided or woven, hence, the greater its shielding effectiveness. The greater flexibility of the fiber mesh, as compared to the wire mesh, also creates a more comprehensive conformity of the mesh to the surface of the underlying insulation. Such improved conformity further improves the closeness and tightness of the mesh shield. This also improves shielding at a higher frequency range.

The fibers have an obvious weight advantage over that of metallic wire, thus providing a solution to a vexatious aspect of the new aerospace specifications.

In addition to the advantages of improved shielding and weight, many of the materials of this invention also enhance the operating temperature range. For example, the fiber materials that are admixed with ceramic and silicon carbide, and the mixture of polyester-polyarylate commingled with glass fibers will each provide a shield having a temperature that can exceed 150° C.

SUMMARY OF THE INVENTION

In accordance with the present invention, there is provided a shielded wire and cable article capable of meeting stringent aerospace specifications and requirements, particularly those pertaining to low weight and high temperature. The article generally comprises an inner conductive core of one or more wires that can be twisted or braided and which can be individually insulated. The conductive core is surrounded by one or more thin layer(s) of insulation about which the shielding of this invention is applied. The shielding comprises a woven, braided or served mesh or woven yarn of metal-coated high-performance fibers. The fibers of the mesh or yarn are characterized by high-tensile strength and flexibility. When the fibers themselves are braided, the resulting mesh can be braided even more tightly about the interior insulation surface than can conventional meshes.

In addition, the high-tensile strength requirement for the yarn makes it possible that a thinner fiber can be utilized, so that a greater shield weight reduction is realized. The metal coating upon the shield fibers is in an approximate thickness range of a few ten to a few hundred angstroms. The thinner metal coating greatly reduces the shielding weight of the shield mesh.

The fibers of the shield layer can comprise high performance liquid crystalline polymers such as poly (p-phenylene- 2,6-benzobisthiazole) [hereinafter referred to as PBT], polybenzoxazole (PBO), polybenzimidazole (PBI), polyester-polyarylate and polyester-polyarylate commingled with glass fibers. The new wire and cable articles of this invention further suggest the use of shielding fibers that comprise ceramic materials, such as silicon carbide and carbon-coated silicon carbide. The invention also contemplates fibers consisting of bridged macrocyclic metal complexes and hybrids, such as poly-phthalocyanines. The fibers may also include inherently conductive materials such as polythiophenes and polyanilines.

The fibers can have approximate weight-to-length ratio in a range of about 50 to a few hundred denier, and, in some cases, up to 10,000 denier. The fibers are operative in a temperature range equal to or exceeding 150° C. The shielding effectiveness of the wire or cable article fabricated in accordance with the invention should, at a minimum, be in a range of at least approximately 1 milliohm/meter to 1 ohm/meter of surface transfer impedance across a frequency range of at least between 100 KHz and 1 GHz.

To complete the shielded wire or cable article of this invention, a thin insulative jacket is disposed about the fiber shield.

The shielding effectiveness (operational frequency range) of the resulting inventive article is comparable to that of conventionally shielded cable. The surface transfer impedance of the shielded wire and cable of the invention is in a range approaching a few hundred milliohms/meters over a frequency range of 100 KHz to 1 Ghz.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the present invention features a shielded wire and cable article having a shielding that is fabricated from metal-coated fibers woven into a yarn or braided or served into a mesh. The shielding layer of the invention utilizes highly flexible fibers with a high tensile strength and high-temperature capabilities. The yarn or braided mesh is disposed about the inner insulated core of the wire or cable. The metallic coating upon the fibers is very thin; it comprises a layer of between approximately a few hundred angstroms to several micrometers in thickness. The weight of the braided fibers is as low as 22% of the conventional metallic mesh; it provides a shielding effectiveness comparable to that of conventional metallic mesh.

Figure 1:
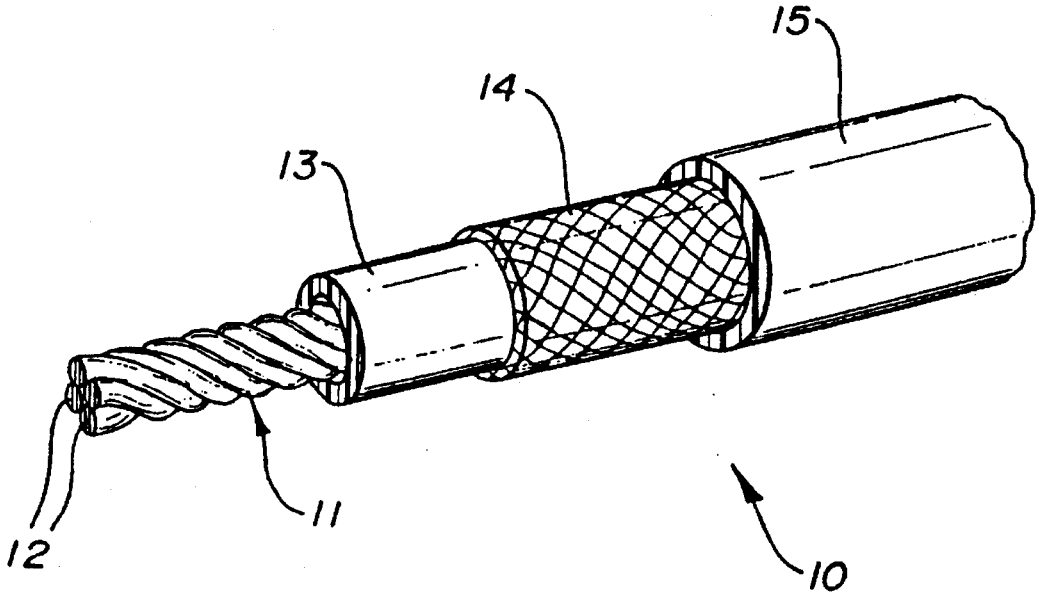
FIG. 1 is a schematic, cutaway, perspective view of the shielded wire or cable article of this invention.

Now referring to FIG. 1, a typical shielded wire or cable article 10 of this invention is illustrated in schematic, cutaway perspective view. The inner, electrically conductive core 11 of the wire or cable 10 is composed of one or more metallic wires 12 (usually of copper). The wires 12 can be straight, twisted or braided, as is conventionally known in the art; they may be bare or individually insulated. The conductive core 11 is covered by one or more thin insulation layer(s) 13, which can be any suitable material that befits the utility and specifications sought. One of the insulation layers 13 may contain ferrite powder.

The shielding layer 14 of this invention is overlaid about the insulation layer(s) 13. The shielding layer 14 can be applied in one of two ways: a) as a thin layer of woven yarn, or b) as a braided or served layer of fibers. The fibers of the yarn or braid are coated with a metal (usually silver). The thickness of the metal coating about each fiber is generally in a range of between approximately a few hundred angstroms to several micrometers in thickness. The fibers are characterized by their high-tensile strength and flexibility, thus allowing a tightly woven yarn or braided mesh. The fibers are also characterized by their high-temperature operative range of approximately equal or greater than 150° C.

Because of their high-tensile strength and flexibility, the fibers can be made thinner, thus reducing their weight and providing for a tighter weave or braiding about the insulation layer 13. The fibers can be chosen from many high-tensile strength materials, such as poly (p-phenylene-2,6-benzobisthiazole) (PBT), polybenzoxazole (PBO), polybenzimidazole (PBI), polyester-polyarylate and polyester-polyarylate commingled with glass fibers. The new wire and cable articles of this invention further suggest the use of shielding fibers that comprise ceramic materials, such as silicon carbide and carbon-coated silicon carbide. The invention also contemplates fibers consisting of bridged macrocyclic metal complexes and hybrids, such as polyphthalocyanines. The fibers may also include inherently conductive materials such as polythiophenes and polyanilines.

The fibers generally have a weight-to-length ratio in a range of approximately between 50 to a few hundred denier, and in some cases up to 10,000 denier.

The metallic coating is applied by a proprietary process, commercially available from Sauquoit Industries, Inc., of Scranton, Pennsylvania. Other known and commercially available processes that can be utilized in coating the metal on the fibers include electrostatic deposition, dielectric deposition, vapor deposition, etc. Over the shield layer 14 is generally disposed one or more jacket layers 15 of insulation. The jacket layer(s) 15 can be made of any number of materials, again befitting the intended purposes and specifications designated for the final cable product.

Figure 1A:
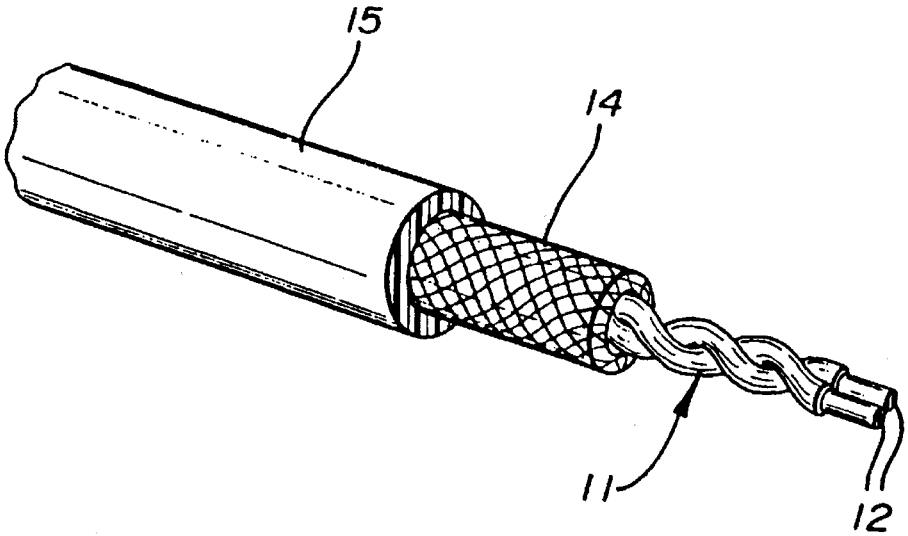
FIG. 1*a* is a schematic, cutaway, perspective view of an alternate embodiment of the shielded cable article illustrated in FIG. 1, wherein the cable forms a twin pair.

Referring to FIG. 1*a*, an alternate embodiment of the cable 10 shown in FIG. 1 illustrates a twin cable construction for the shielded article of this invention.

EXAMPLE 1

A wire construction was fabricated, utilizing the materials described hereinbelow.

For the conductive core, a center conductor was utilized, comprising AWG 22 tin-coated copper wire manufactured by Hudson Wire Company. The conductive core was overlaid with a layer of primary insulation of Kynar 460 polyvinylidene fluoride supplied by Atochem Company. About this primary insulation was overlaid a second insulation layer of Viton® fluorinated rubber filled with ferrite powder (82%) supplied by DuPont. The second layer was then overlaid with Exrad® irradiated, cross-linked ethylene tetrafluoroethylene copolymer manufactured by Champlain Cable Corporation, Winooski, Vt. The third layer was overlaid with the shielding of this invention. The final wire was not jacketed. The total outside diameter was 0.069". The shielding can consist of silver-coated PBT fibers braided into a mesh about the insulation layers, the fibers having a weight of approximately 0.4 lbs. per 1,000 feet.

Conventional tin-copper braided wire has twice the weight of the metal-coated fiber shielding of the invention. This results in a total cable weight of approximately 0.75 lbs. per 1,000 feet.

EXAMPLE 2

A second cable was fabricated utilizing the silver-plated copper core (AWG 22) of EXAMPLE 1. About the conductive core was overlaid an insulation layer of irradiated, cross-linked ethylene tetrafluoroethylene copolymer. The insulated conductive core consisted of a twisted pair whose length of lay is about one inch (left-handed lay). A shield was disposed over the twisted pair. It can consist of silver-coated PBO fiber that is braided to provide a coverage exceeding 90%. Over this was jacketed a layer of cast tape (FEP-coated Teflon®).

EXAMPLE 3

A cable was fabricated with a construction similar to that described in EXAMPLE 1, with the exception that the braid can consist of metal-coated fibers consisting of PBI.

EXAMPLE 4

An RG 302 coaxial cable was modified in accordance with the invention. The cable normally comprises a silver-plated copper solid conductor (AWG 22, OD=0.025") insulated with polyethylene (total OD=0.143") and shielded with a silver-plated copper braid (92% coverage). The coaxial cable can be modified by replacing the metal shield layer with a silver-plated polyester-polyarylate fiber braid. The polyester-polyarylate material can be commingled with glass fibers to improve the high-temperature capabilities of the yarn.

A Wardwell fabric braiding machine, manufactured by Wardwell Braiding Machine Company of Rhode Island, can be used with 16 or 24 spools of a two-end silver-coated fiber yarn.

The conductive core of the cable of this invention can comprise one or more bare metallic wires or metallic wires having individual layers of insulation. These wires may be straight, twisted or braided; they are then covered with one or more thin layers of insulation and jacketing.

The cable article of this invention may be fabricated as a cable pair. Insulated cores can themselves be paired or be formed into a multicore member, which can then be shielded and jacketed.

The jacket layer(s) can comprise at least one material selected from a group of materials consisting of fluoropolymer, a fluorocopolymer, a polyimide, a halogen-free insulation, and an irradiated, cross-linked ethylene-tetrafluoroethylene polymer.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented by the subsequently appended claims.

What is claimed is:

1. A cable article having shielding capability, comprising:

a conductive core member;

at least one layer of insulation disposed over said conductive core member;

a layer of shield material consisting of metal-coated fibers having an operative temperature range exceeding approximately 150° C., said metal-coated fibers being braided or served into a mesh to provide a protective shield layer disposed over the insulated conductive core member, said served mesh providing shielding effectiveness in a range of at least approximately between 1 milliohm/meter to 1 ohm/meter of surface transfer impedance across a frequency range of at least between 100 KHz and 1 GHz, said metal-coated fibers being selected from a group of materials consisting of poly(p-phenylene-2,6-benzobisthiazole), polybenzoxazole, polybenzimidazole, polyester-polyarylate and polyester-polyarylate commingled with glass fibers; and a jacket disposed over said protective shield layer comprising at least one layer of material.

2. The cable article in accordance with claim 1, wherein said protective shield layer comprises fibers coated with silver.

3. The cable article in accordance with claim 1, wherein said conductive core member comprises a plurality of metallic wires that are straight, served or twisted.

4. The cable article in accordance with claim 1, wherein said conductive core member comprises a plurality of metallic wires that are individually insulated.

5. The cable article in accordance with claim 1, formed into a twin pair of cables.

6. The cable article in accordance with claim 1, wherein said conductive core member comprises a multicore member.

7. The cable article in accordance with claim 1, wherein said jacket is selected from at least one material from a group of materials consisting of fluoropolymers; fluorocopolymers; polyimides; halogen-free insulation; and irradiated, cross-linked ethylene-tetrafluoroethylene polymers.

8. The cable article in accordance with claim 1, wherein said at least one insulation layer is selected from at least one material from a group of materials consisting of fluoropolymers; fluorocopolymers; polyimides; halogen-free insulation; and irradiated, cross-linked ethylene-tetetrafluoroethylene polymers.

9. The cable article of claim 1, wherein the coated fibers of the shield layer are coated with a metal selected from a group consisting of silver, copper and nickel.

10. A light-weight cable article having shielding capability, comprising:

a conductive core member;

at least one layer of insulation disposed over said conductive core member;

a layer of shield material consisting of metal-coated fibers having an operative temperature range exceeding approximately 150° C., said metal-coated fibers being braided or served into a mesh to provide a protective shield layer disposed over the insulated conductive core member, said served mesh forming a shield layer that exceeds 90% coverage of said at least one layer of insulation and providing shielding effectiveness in a range of at least approximately between 1 milliohm/meter to 1 ohm/meter of surface transfer impedance across a frequency range of at least between 100 KHz and 1 GHz, said metal-coated fibers being selected from a group of materials consisting of poly(p-phenylene-2,6-benzobisthiazole), polybenzoxazole, polybenzimidazole, polyester-polyarylate and polyester-polyarylate commingled with glass fibers; and a jacket layer disposed over said protective shield layer.

11. The cable article in accordance with claim 10, wherein said protective shield layer comprises fibers coated with silver.

12. The cable article in accordance with claim 10, wherein said conductive core member comprises a plurality of metallic wires that are served or twisted.

13. The cable article in accordance with claim 10, wherein said conductive core member comprises a plurality of metallic wires that are individually insulated.

14. The cable article in accordance with claim 10, formed into a twin pair of cables.

15. The cable article in accordance with claim 10, wherein said conductive core member comprises a multicore member.

16. The cable article in accordance with claim 10, wherein said jacket is selected from at least one material from a group of materials consisting of fluoropolymers; fluorocopolymers; polyimides; halogen-free insulation; and irradiated, cross-linked ethylene-tetrafluoroethylene polymers.

17. The cable article in accordance with claim 10, wherein said at least one insulation layer is selected from at least one material from a group of materials consisting of fluoropolymers; fluorocopolymers; polyimides; halogen-free insulation; and irradiated, cross-linked ethylene-tetrafluoroethylene polymers.

18. The cable article of claim 10, wherein the coated fibers of the shield layer are coated with a metal selected from a group consisting of silver, copper and nickel.

* * * * *